US008371242B2

(12) United States Patent
Gelain

(10) Patent No.: US 8,371,242 B2
(45) Date of Patent: Feb. 12, 2013

(54) POWDER COATING CABIN OR SUBSTRUCTURE THEREFOR

(75) Inventor: Silvano Gelain, Abtwill (CH)

(73) Assignee: ITW Gema GmbH, St. Gallen (CH)

( * ) Notice: Subject to any disclaimer, the term of this patent is extended or adjusted under 35 U.S.C. 154(b) by 713 days.

(21) Appl. No.: 11/720,792

(22) PCT Filed: Dec. 8, 2005

(86) PCT No.: PCT/IB2005/003711

§ 371 (c)(1),
(2), (4) Date: Jun. 24, 2009

(87) PCT Pub. No.: WO2006/061702

PCT Pub. Date: Jun. 15, 2006

(65) Prior Publication Data

US 2009/0272317 A1 Nov. 5, 2009

(30) Foreign Application Priority Data

Dec. 9, 2004 (DE) ..... 10 2004 059 602

(51) Int. Cl.
*B05C 21/00* (2006.01)

(52) U.S. Cl. ..... 118/326; 118/64; 118/600; 118/610; 52/302.1

(58) Field of Classification Search ..... 118/325, 118/64, 600, 610; 454/50, 51, 53, 62, 63; 52/302.1

See application file for complete search history.

(56) References Cited

U.S. PATENT DOCUMENTS

| | | | | |
|---|---|---|---|---|
| 4,413,584 | A * | 11/1983 | DiMaggio et al. | 118/56 |
| 4,704,953 | A * | 11/1987 | Wilson | 454/53 |
| 6,123,259 | A | 9/2000 | Ogasawara | |
| 6,415,156 | B1 | 7/2002 | Stadelmann | |
| 6,680,923 | B1 | 1/2004 | Leon | |
| 6,997,991 | B2 | 2/2006 | von Keudell et al. | |
| 7,127,236 | B2 | 10/2006 | Khan et al. | |
| 7,155,405 | B2 | 12/2006 | Petrovich | |
| 2002/0072320 | A1 * | 6/2002 | Shutic et al. | 454/50 |
| 2002/0143655 | A1 | 10/2002 | Elston et al. | |
| 2003/0220876 | A1 | 11/2003 | Burger et al. | |
| 2004/0015414 | A1 | 1/2004 | Sidlo et al. | |
| 2004/0029569 | A1 | 2/2004 | Khan et al. | |
| 2004/0210498 | A1 | 10/2004 | Freund | |
| 2005/0050367 | A1 | 3/2005 | Burger et al. | |

FOREIGN PATENT DOCUMENTS

| | | | |
|---|---|---|---|
| DE | 7014433 | U1 | 4/1970 |
| DE | 20218192 | U1 | 3/2003 |
| DE | 20305947 | U1 | 6/2003 |

(Continued)

*Primary Examiner* — Laura Edwards
(74) *Attorney, Agent, or Firm* — Lowe Hauptman Ham & Berner LLP

(57) ABSTRACT

In a powder spraycoating cabin or substructure for same, a cabin bottom contains bottom flaps configured near outer longitudinal walls and a walk-on bottom part situated between the bottom flaps. The bottom flaps are rotatable about an axis of rotation running in the lengthwise cabin direction, as a result of which the width of lengthwise bottom gaps situated bilaterally about the flaps can be varied. A suction duct is situated underneath. The walk-on bottom part is fitted with compressed-air outlets to blow compressed air toward/into the lengthwise bottom gaps.

13 Claims, 6 Drawing Sheets

FOREIGN PATENT DOCUMENTS

| | | | | |
|---|---|---|---|---|
| DE | 20121880 | U1 | | 10/2003 |
| DE | 103 50 332 | A1 | | 5/2005 |
| EP | 0698421 | | * | 2/1996 |
| EP | 1 125 639 | A1 | | 8/2001 |
| EP | 1 162 002 | A | | 12/2001 |
| JP | 2000163487 | A1 | | 6/2000 |
| JP | 2002056278 | A1 | | 2/2002 |
| JP | 2002245554 | A1 | | 8/2002 |
| JP | 2002366627 | A1 | | 12/2002 |
| JP | 3931541 | B2 | | 6/2007 |

* cited by examiner

POWDER COATING CABIN OR SUBSTRUCTURE THEREFOR

RELATED APPLICATIONS

The present application is based on, and claims priority from, German Application Number 10 2004 059 602.6, filed Dec. 9, 2004, the disclosure of which is hereby incorporated by reference herein in its entirety.

FIELD OF THE INVENTION

The present invention relates to a powdercoating cabin or a substructure for same.

BACKGROUND OF THE INVENTION

Comparable powdercoating cabins or a substructure for same are known from the European patent document EP 1 162 002 A2 and the German Gebrauchsmuster DE 203 05 947 U1.

SUMMARY OF THE INVENTION

The objective of the present invention is to create a way to reduce the height of the lower cabin region, or the height of the substructure. Another objective is to increase spray-coating efficiency.

This problem is solved by the features of the present invention.

Further features of the present invention are defined in its dependent claims.

BRIEF DESCRIPTION OF THE DRAWING

The invention is elucidated in illustrative manner below by means of preferred embodiment modes and in relation to the appended drawings.

DETAILED DESCRIPTION OF THE DRAWINGS

Within the scope of the present invention, all elements/components that are situated within a powder spraycoating cabin underneath the path(s) followed by the objects to be coated and underneath the spray jets emitted from spray equipment, the latter also called "sprayguns", as a whole shall be considered constituting the "cabin bottom".

Figure 1:
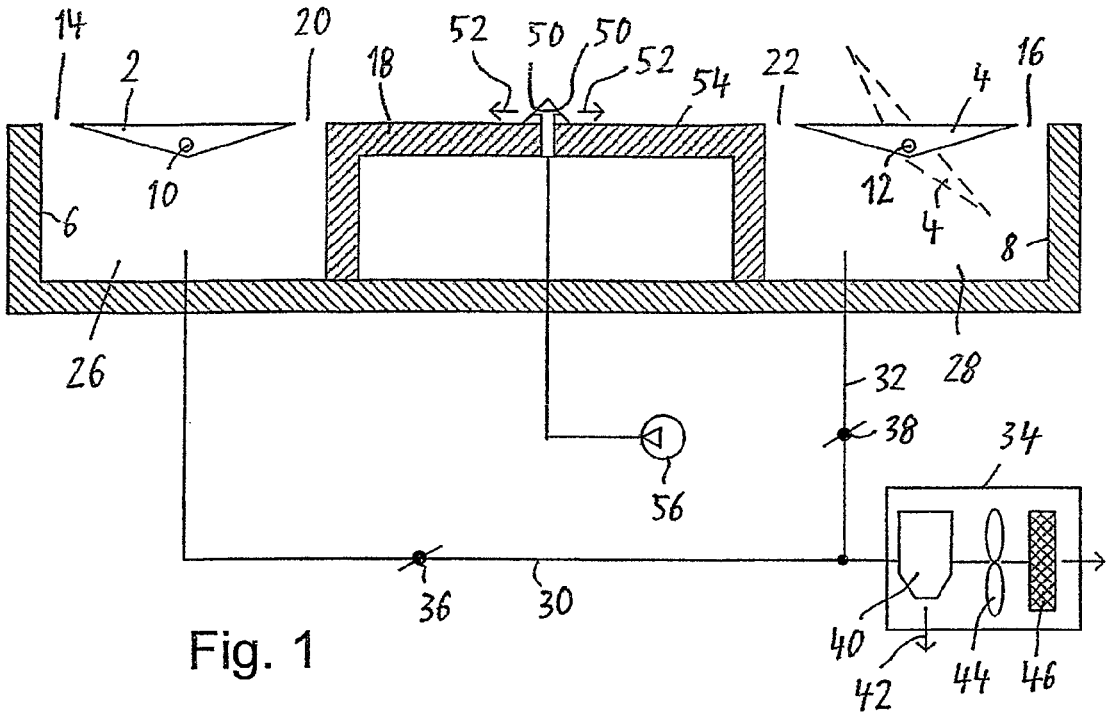
FIG. 1 is a schematic vertical section of the lower end portion or a substructure of a powder spraycoating cabin of the invention.

In the embodiment mode of FIG. 1, outer bottom flaps 2 and 4 are configured adjacently to the outer longitudinal walls 6 and 8 and are rotatable about a longitudinal axis of rotation 10 respectively 12. A lengthwise outer bottom gap 14 respectively 16 is subtended between the outer bottom flaps 2, 4 and their adjacently outer longitudinal walls 6, 8.

At least one further bottom part 18 is present between the two outer bottom flaps 2 and 4, at least one such bottom part from such (a) bottom part(s) being configured as the bottom central part centrally in the cabin's transverse direction. As regards the embodiment mode of FIG. 1, the further bottom part simultaneously is the central bottom part 18. A lengthwise inner bottom gap 20 respectively 22 is subtended each time between the outer bottom flap 2, 4 and its adjacent minimum of one bottom part, the latter being the central bottom part 18 in FIG. 1.

The width of the lengthwise outer and inner bottom gaps 14, 16, 20 and 22 may be adjusted by rotating their adjacent bottom flaps, in this instance the outer bottom flaps 2 and 4, about their axes of rotation 10 and 12.

The outer bottom flap 2 and its adjacent longitudinal gaps 14 and 20 overlap a suction duct 26 running in the lengthwise direction of the cabin and preferably over its full length. The other bottom flap 4 and its adjacent longitudinal gaps 16 and 22 overlap a further suction duct 28 running in the lengthwise direction of the cabin and preferably over its full length.

The two suction ducts 26 and 28 are connected by fluid lines 30 respectively 32 to a powder suction device 34, preferably a powder recovery device. A flow throttle 36 respectively 38 may be configured at the outlet of the suction ducts 26 and 28 or in the fluid lines 30 and 32, whereby, when closing one of the two flow throttles, the suction in the associated other fluid line, and hence in the associated other suction duct 26 or 28 shall be increased. The design of the powder suction device is arbitrary. Illustratively it may contain a cyclone separator to precipitate recovered excess powder 42, a suction blower 44 and an exhaust air filter 46 through which the air aspirated out of the powder spraycoating cabin may be expelled into the atmosphere.

The central bottom part 18 of FIG. 1 is designed to support the weight of one person on it. This walk-on bottom part 18 is fitted at its top side with compressed-air outlets 50 to blow compressed air 52 across the surface 54 of said bottom part toward at least one, or, as shown in FIG. 1, toward both inner lengthwise bottom gaps 20 and 22.

The compressed-air outlets 50 are connected to a source of compressed air 56, for instance a pressure regulator or another pressure control implement which in turn is connected to a dispenser of compressed air, for instance a compressed-air network or a compressed-air container.

FIG. 1 shows the two outer bottom flaps 2 and 4 in a horizontal position of rotation wherein the lengthwise bottom gaps 14, 16, 20 and 22 assume their minimum widths. The outer bottom flaps 2 and 4 are designed in a manner that in this position their surfaces shall be flush with the surface 54 of the walk-on bottom part 18. Excess powder accumulating during coating powder spraying may drop through the lengthwise bottom gaps 14, 16, 20 and 22 into the suction ducts 26 and 28.

As is illustratively shown in FIG. 1 by a dashed position of the bottom flap 4, the bottom flaps 2 and 4 may be rotated into an oblique position for the purpose of cleaning the powder spraycoating cabin. In this manner an operator blow-cleaning the powder spray-coating cabin using a compressed-air gun or a compressed-air lance also may view the inside of the suction ducts 26 and 28 to check their cleanliness. Moreover the bottom flaps 2, 4 may be rotated farther enough to allow cleaning their bottom sides with compressed air.

Figure 2:
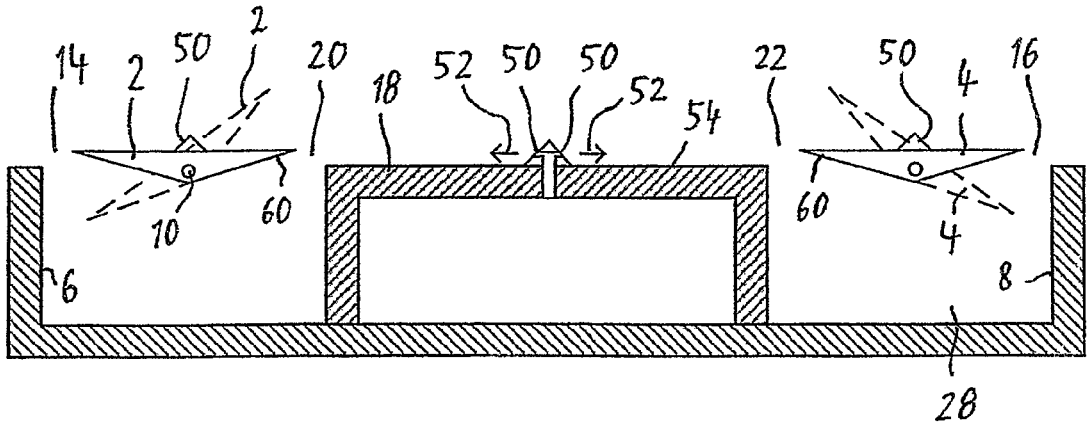
FIG. 2 is a schematic vertical section of a lower end portion or a substructure of a powder spraycoating cabin of another embodiment mode of the invention.

The embodiment of FIG. 2 is identical with that of FIG. 1 except in that—when the outer bottom flaps 2 and 4 are set for the minimum widths of their adjacent bottom length-wise gaps 14, 16—they shall be configured higher than the surface 54 of the walk-on bottom part 18, at least the undersides 60 of the bottom flaps 2, 4 being higher by their inner end than the surface 54 of the walk-on bottom part 18, as a result of which these alar undersides 60 shall guide powder blown away by the compressed air 52 into the suction ducts 26 respectively 28.

FIG. 2 shows the bottom flaps 2 and 4 in solid lines and in a horizontal attitude during spraycoating and in dashed lines in an oblique position during powder spraycoating cabin cleaning. When the bottom flaps 2 and 4 are in their shown oblique position, an operator may view even the lower corners of the suction ducts 26 and 28 and observe whether the said suction ducts were properly cleaned. The bottom flaps 2 and 4 also may be designed to be rotatable by 180° in a manner that their undersides are turned upward and in that position can be also blown clean with compressed air for the purpose of cleaning prior to color changing (change of powder).

Figure 3:
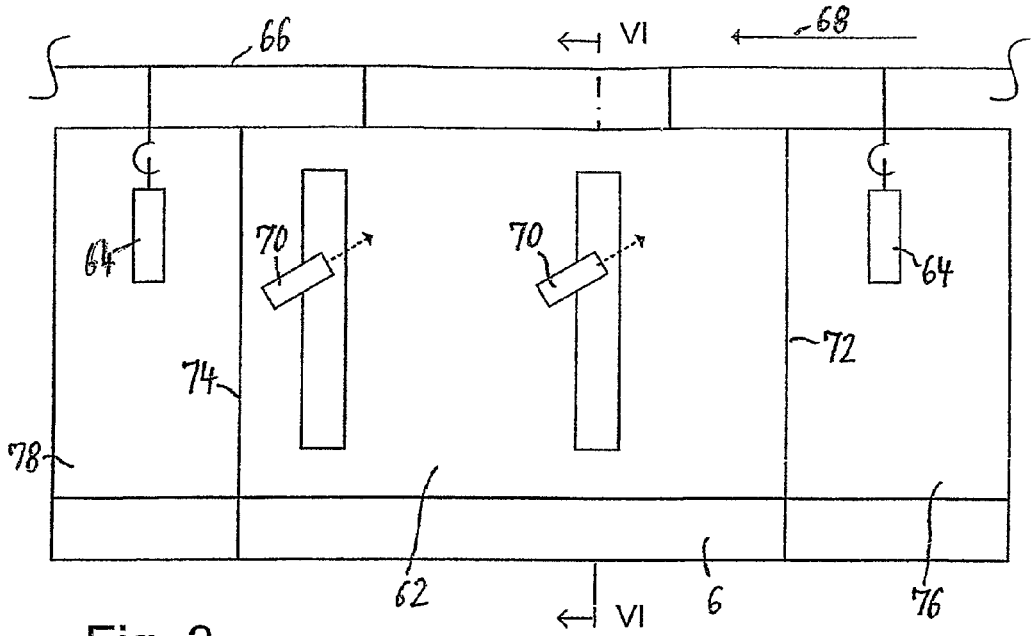
FIG. 3 is a schematic sideview of a powder spraycoating cabin of the invention.
Figure 4:
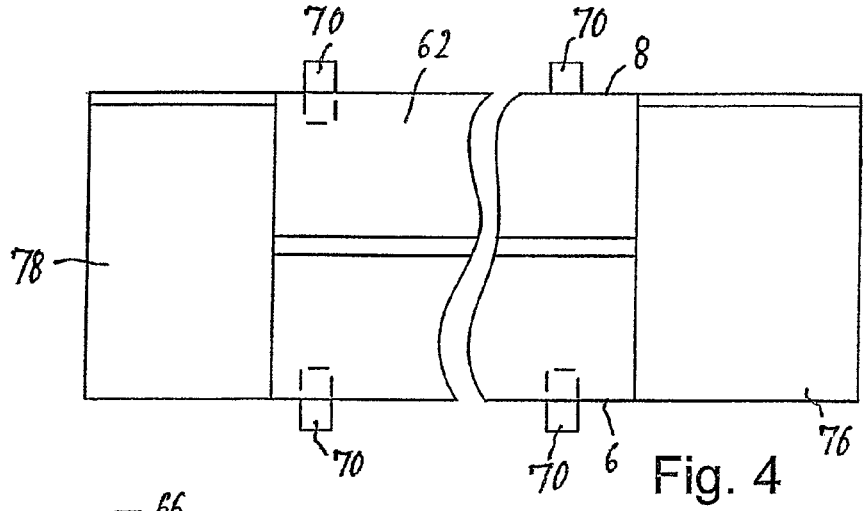
FIG. 4 is a schematic topview of the powder spraycoating cabin of FIG. 3.
Figure 5:
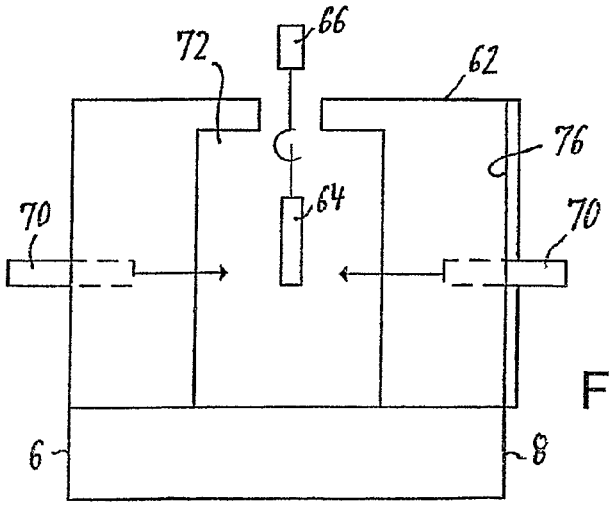
FIG. 5 is an end-face elevation of the powder spraycoating cabin of FIG. 3 seen from the right.
Figure 6:
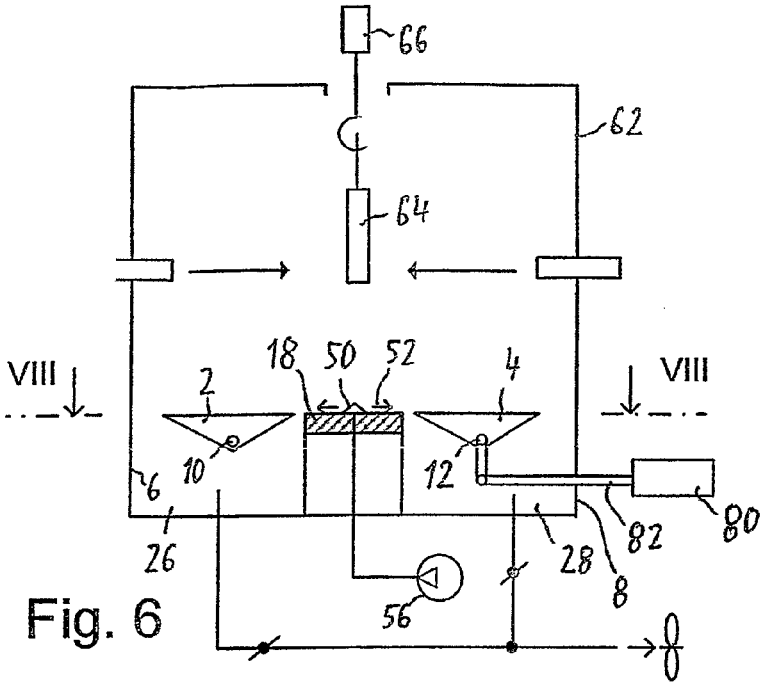
FIG. 6 is a schematic vertical section elevation along the plane VI-VI of FIG. 3.
Figure 7:
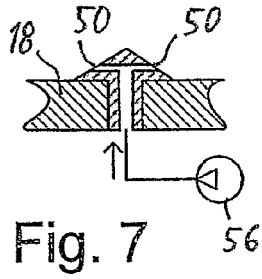
FIG. 7 is a detail of FIG. 6 on an enlarged scale.

The powder spraycoating cabin 62 shown in FIGS. 3, 4 and 5 is designed in its lower portion in the manner shown in FIGS. 1 and 2 or is fitted with a substructure as shown in FIGS. 1 and 2. Objects to be coated 64 may be moved by a suspension trolley 66 in the longitudinal direction of advance 68 through the powder spraycoating cabin 62 and may be sprayed with powder using automated spray guns 70. A free-hand spraycoating site 76 respectively 78 may be located outside the spraycoating cabin at its intakes and outlets 72 and 74.

FIGS. 6, 7, 8 and 9 show that the bottom flaps 2 and 4 of the spraycoating cabin 62 may be rotated by a drive 80 into various rotational positions about an axis of rotation 10 respectively 12 running in the longitudinal cabin direction. Alternatively each bottom flap may be fitted with its own drive or a joint drive may be used for all bottom flaps. The drive 80 may be an electric, pneumatic or hydraulic motor, preferably it shall be a cylinder fitted with a reciprocating plunger 82 driving the particular bottom flap 2 and/or 4 in either direction.

The bottom flaps 2 and 4 also may be fitted at their top sides with compressed air outlets 50 with which to blow compressed air either of the adjacent bottom lengthwise gaps 14, 16 and 20. In general however compressed air outlets 50 at the walk-on bottom part 18 do suffice to clean the surfaces of the bottom flaps 2 and 4.

The compressed air may be fed to the compressed air outlets 50 of the bottom flaps 2 and 4 preferably through a compressed air path 84 which runs axially to the axis of rotation 10 respectively 12 into the particular bottom flap 2, 4 and, within the bottom flap, transversely to the axis of rotation up to the top side of said bottom flap.

Figure 8:
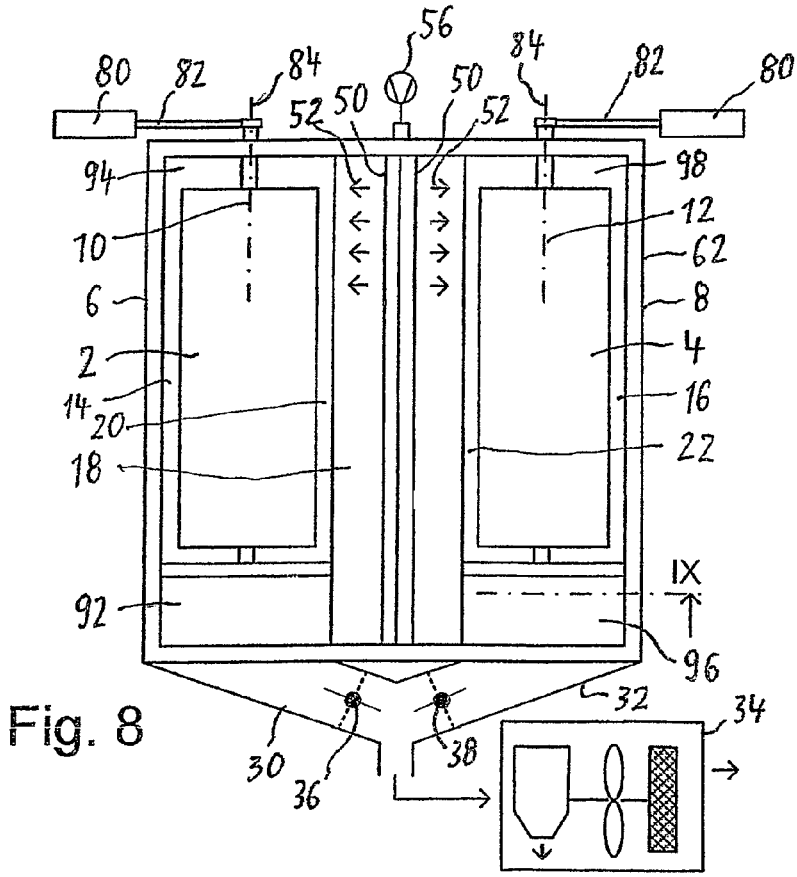
FIG. 8 is a schematic topview of the powder spraycoating cabin or its substructure of FIG. 1.
Figure 9:
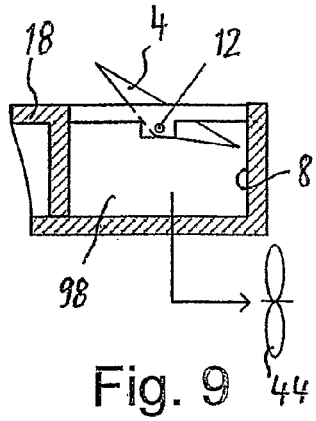
FIG. 9 is a detail of FIG. 8 shown in vertical section along the plane IX-IX of FIG. 8, FIG. 10 schematically shows a vertical cabin section of a further embodiment of the invention.

A suction aperture 92, 94, 96, 98 is each situated above one of the suction ducts 26 respectively 28, at least at one, preferably both longitudinal ends in the powder spraycoating cabin in its lower portion that may be designed as the cabin sub-structure. Said suction apertures preferably are configured adjacent to the end faces of the outer bottom flaps 2, 4 and opposite them, as schematically indicated in FIG. 8.

Figure 12:
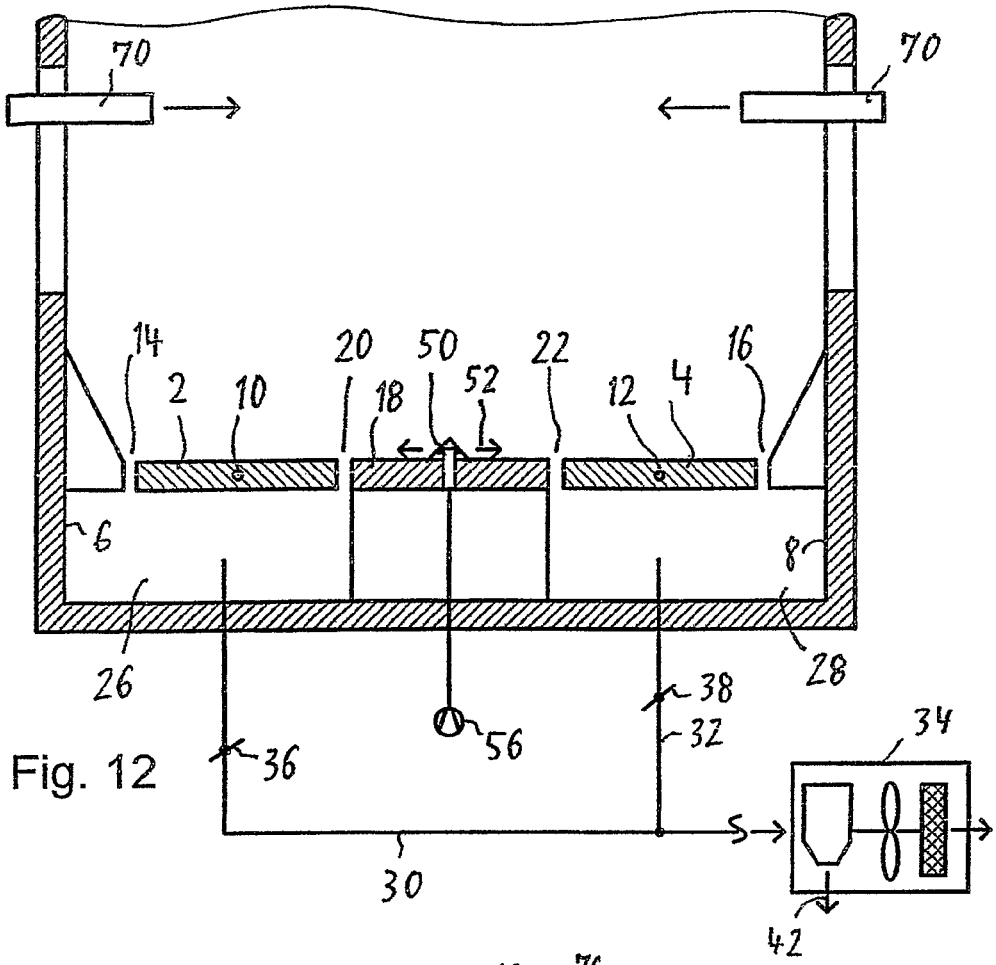
FIG. 12 is a schematic vertical section of still another embodiment of the invention.
Figure 13:
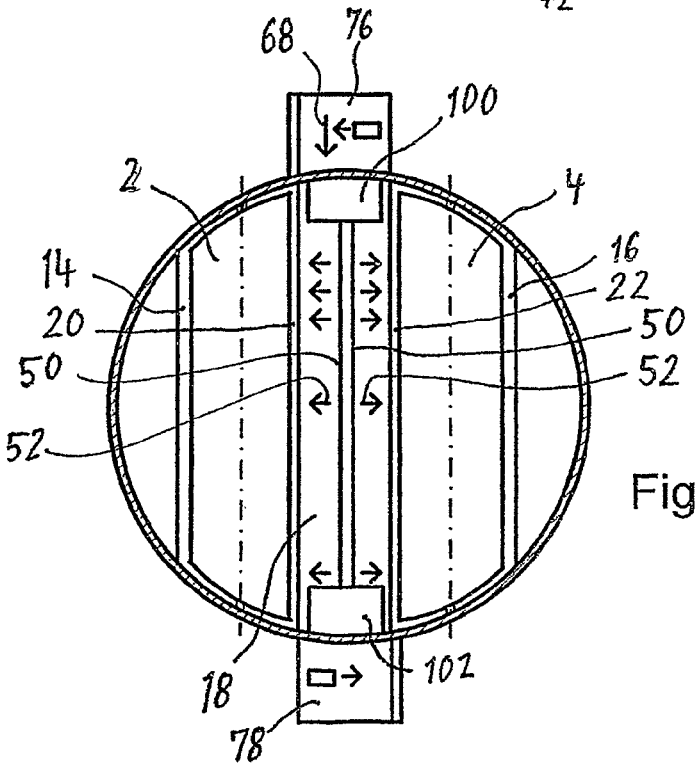
FIG. 13 is a schematic topview of the powder spraycoating cabin of the invention, of FIG. 12.

In the embodiment mode shown in FIGS. 12 ands 13, the said suction apertures instead may be constituted by the bottom flaps 2, 4 at the end-face side or additionally they may be constituted at the lengthwise ends of the walk-on central bottom part 18 as shown in FIG. 13 for the suction apertures 100 and 102. FIGS. 12 and 13 show a horizontally, cross-sectional round-circular cabin whereas the other Figures do show a horizontally cross-sectionally square cabin.

Figure 14:
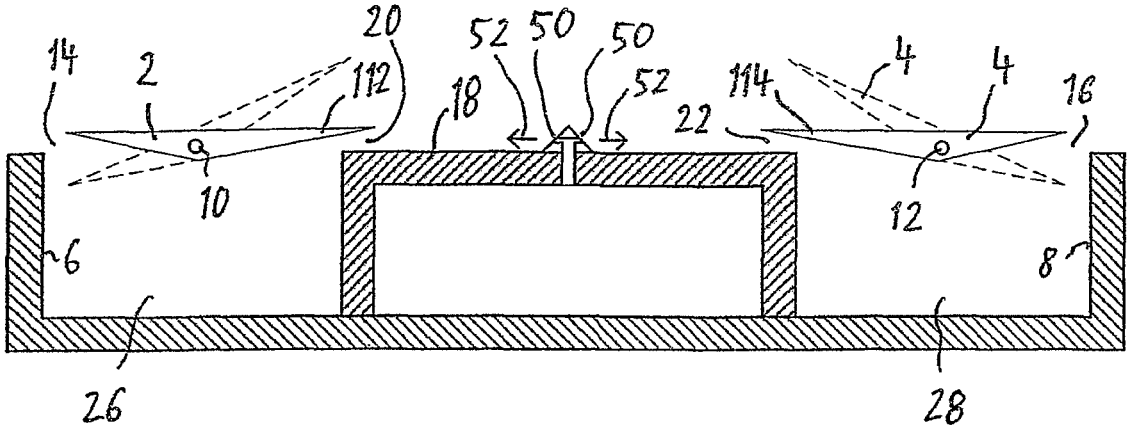
FIG. 14 is a schematic vertical section of a further embodiment of a lower portion or substructure of a powder spraycoating cabin of the invention.

FIG. 14 shows an embodiment similar to that of FIG. 2 except that in FIG. 14 the inner flap segment 112 respectively 114 of the two bottom flaps 2, 4 overlaps the adjacent bottom part 18 when said flaps are positioned for the minimal width of the lengthwise bottom gap 14, 16, 20 and 22. This configuration reinforces powder suction in the horizontal direction while reducing it in the vertical direction, toward the objects to be coated. This feature reduces the interference affecting the spray coating cloud sprayed onto the objects to be coated.

Figure 10:
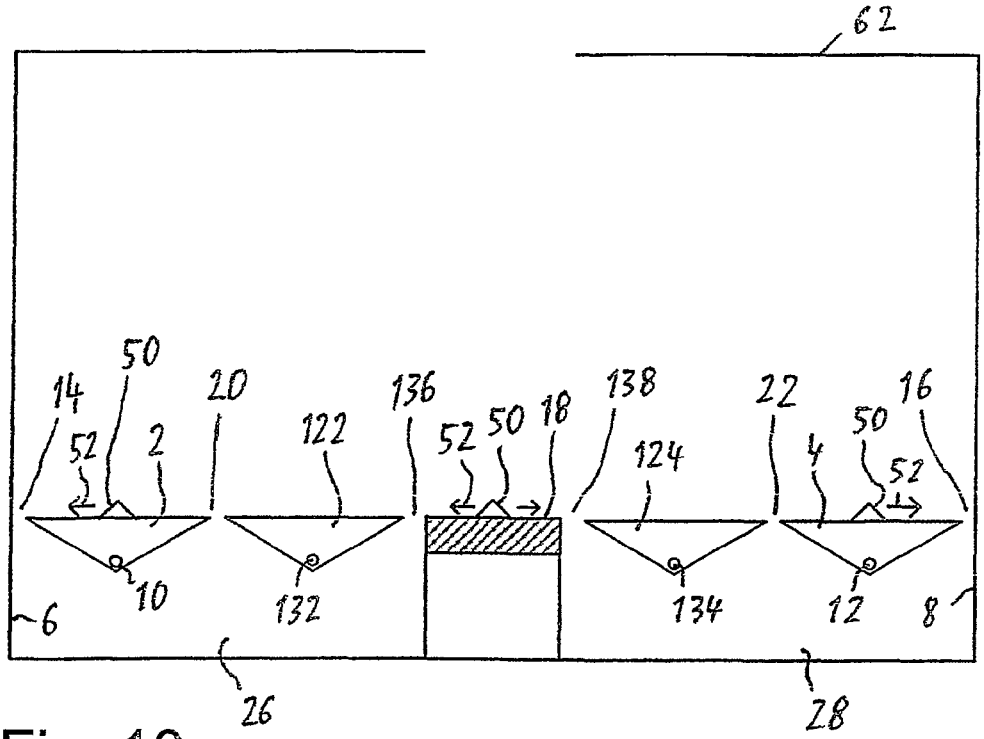

FIG. 10 shows a embodiment of the lower portion or a substructure of a powder spraycoating cabin of the invention wherein the central bottom part again is designed as the walk-on bottom part 18. A double-wing inner bottom flap 122 respectively 124 is configured between said walk-on bottom part 18 and the two outer bottom flaps 2 and 4, said dual-wing inner bottom flaps each being rotatable about a longitudinal axis 132 respectively 134. At their outsides and jointly with the outer bottom flaps 2 respectively 4, the inner bottom flaps 122, 124 bound the inner longitudinal gaps 20 respectively 22. Furthermore, jointly with the walk-on bottom part 18, the inner bottom flaps 122 respectively 124 bound lengthwise innermost bottom gaps 136 respectively 138. The two bottom flaps 2 and 122 and the lengthwise bottom gaps 14, 20 and 136 which they bound overlap the suction duct 26. The other two bottom flaps 4, 124 and the lengthwise bottom gaps 16, 22 and 138 they bound overlap the other suction duct 28.

Figure 11:
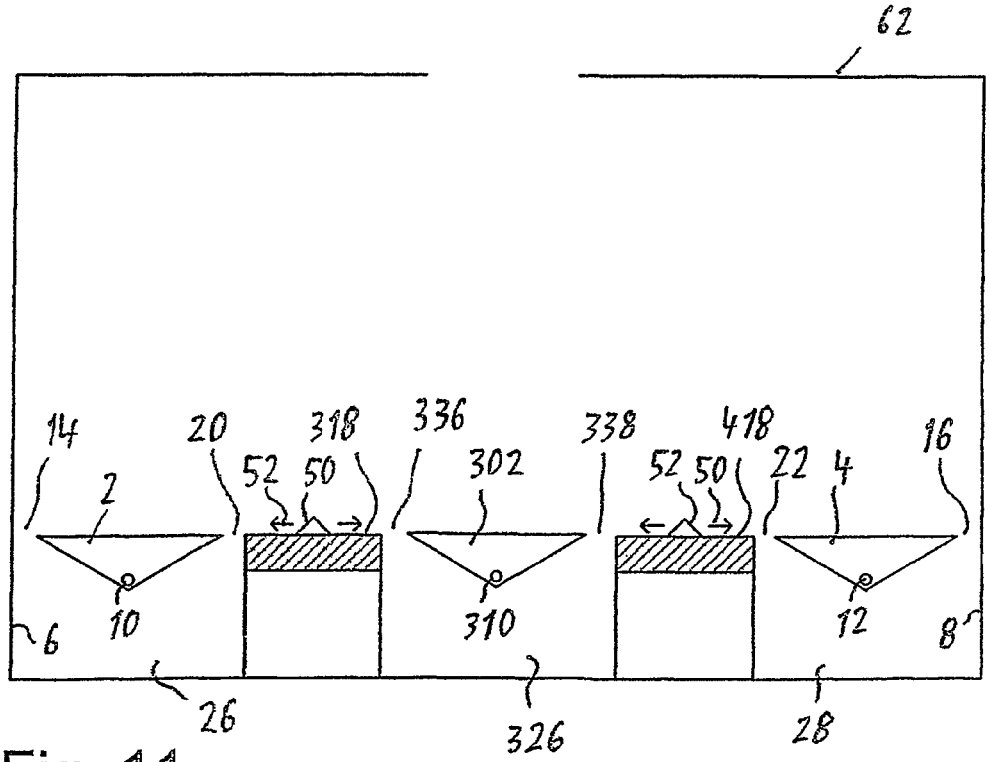
FIG. 11 is a schematic vertical cabin section of still another embodiment of the invention.

FIG. 11 schematically shows a further embodiment of a lower portion or a substructure of a powder spraycoating cabin wherein the central bottom part is a central body flap 302 which is rotatable about a longitudinal axis of rotation 310. An operator walk-on bottom part 318 respectively 418 is configured between the central body flap 302 and the two outer bottom flaps 2 and 4, said walk-on bottom part at its inside and jointly with the central bottom flap 302 subtending an innermost lengthwise bottom gap 336 respectively 338 and on its outside jointly with the particular outer bottom flap 2 respectively 4 subtending one of the inner lengthwise bottom gaps 20 respectively 22. The central bottom flap 302 and the lengthwise bottom gaps 336 and 338 overlap a suction duct 326.

The suction ducts 26, 28 or 26, 28, 326 are connected to a common powder suction unit 34 in all embodiments in the manner shown in FIG. 1. However the suction ducts also may be connected separately to their own powder suction devices.

Furthermore embodiments of the invention offer the feasibility to configure the lengthwise bottom gap transversely farther from the center of the cabin or substructure at a larger gap width than those nearer the cabin center in order to attain stronger suction in the edge zones of said cabin than near the cabin center.

Moreover embodiments of the invention allow configuring the individual bottom components 2, 4, 18, 302, 318, 418 in a manner that, transversely from the cabin center to the cabin side walls, the bottom components will optionally increase/decrease in height in stepped manner.

In embodiment modes of the present invention, the axis of rotation 10, 12 respectively 132, 134 respectively 310 preferably shall be situated a distance away from the lateral flap ends, preferably at the center of the flaps as shown in the drawings, as a result of which the bottom flaps also may be "dual-wing bottom flaps".

The invention claimed is:

1. A powder spraycoating cabin substructure, above which objects to be coated are movable in a longitudinal direction, the substructure comprising:

outer longitudinal walls, outer bottom flaps configured adjacently to the outer longitudinal walls and rotatable about respective axes of rotation which extend in the longitudinal direction, outer lengthwise bottom gaps, each being subtended between an outer side of one of the outer bottom flaps and a corresponding one of the longitudinal walls;

at least one further bottom part being subtended between the two outer bottom flaps, said at least one further bottom part including a central bottom part positioned at a center of the substructure in a transverse direction perpendicular to the longitudinal direction; and inner lengthwise bottom gaps, each being subtended between an inner side of one of the outer bottom flaps and an outer side of an adjacent further bottom part;

wherein a width of each of the lengthwise bottom gaps is adjustable by a rotation of the adjacent outer bottom flap;

the outer bottom flaps and the outer lengthwise bottom gaps are configured above and overlap at least one suction duct;

said at least one further bottom part includes a walk-on bottom part;

compressed-air outlets are fitted to a top side of the walk-on bottom part to blow compressed air across a surface of the walk-on bottom part toward at least one of the outer lengthwise bottom gaps situated on both longitudinal sides of the walk-on bottom part.

2. The powder spraycoating cabin substructure, as claimed in claim 1, wherein the central bottom part is the walk-on bottom part, and the inner lengthwise bottom gaps are subtended between said central bottom part and the corresponding outer bottom flaps.

3. The powder spraycoating cabin or substructure for same as claimed in claim 1, further comprising inner bottom flaps, each being configured between the walk-on bottom part, which is the central bottom part, and corresponding one of the two outer bottom flaps, each of the inner bottom flaps are rotatable about an axis of rotation that extends in the longitudinal direction; wherein each of the inner lengthwise bottom gaps is subtended between an outer side of one of the inner bottom flaps and the corresponding one of the outer bottom flaps;

innermost lengthwise bottom gaps are each subtended between an inner side of one of the inner bottom flaps and the walk-on central bottom part;

the inner bottom flaps and the innermost lengthwise bottom gaps are configured above and overlap the at least one suction duct.

4. The powder spraycoating cabin substructure as claimed in claim 1, wherein the central bottom part is a bottom flap rotatable about an axis of rotation that extends in the longitudinal direction;

two walk-on bottom parts are configured each between the central bottom flap and one of the outer bottom flaps;

innermost lengthwise bottom gaps are each subtended between an inner side of one of the walk-on bottom parts and the central bottom flap;

the two inner lengthwise bottom gaps are each subtended between an outer side of one of the walk-on bottom parts and the associated outer bottom flap;

the central bottom flap and the innermost lengthwise bottom gaps are configured above the at least one suction duct, said suction duct is open relative to the central bottom flap and relative to the innermost lengthwise bottom gaps.

5. The powder spraycoating cabin substructure as claimed in claim 1, wherein a top side of at least one of the outer bottom flaps is fitted with compressed-air outlets to blow compressed air toward at least the lengthwise bottom gaps associated with said outer bottom flap.

6. The powder spraycoating cabin substructure as claimed in claim 5, wherein a path for compressed-air is configured axially relative to the axis of rotation of said outer bottom flap and then transversely to the axis of rotation on the top side of said outer bottom flap.

7. The powder spraycoating cabin substructure as claimed in claim 1, wherein said substructure is fitted at least at one longitudinal end with at least one suction aperture above said at least one suction duct and communicating with said suction duct.

8. The powder spraycoating cabin substructure as claimed in claim 7, wherein the at least one suction aperture is configured opposite an end face of one of the outer bottom flaps.

9. The powder spraycoating cabin substructure as claimed in claim 1, wherein at least one suction aperture is configured in a longitudinal end segment of the walk-on bottom part or adjoins an end face of the walk-on bottom part.

10. The powder spraycoating cabin substructure claimed in claim 1, wherein several suction ducts are allotted to different lengthwise bottom gaps and to different said outer bottom flaps.

11. The powder spraycoating cabin substructure as claimed in claim 1, wherein the lengthwise bottom gaps configured transversely farther away from the center of the substructure in the transverse direction exhibit a gap width defined for spraycoating which is wider than the gap width of the lengthwise bottom gaps located closer to the center.

12. The powder spraycoating cabin substructure as claimed in claim 1, wherein said at least one bottom part includes inner and outer bottom part, and the outer bottom parts which are transversely farther from the center of said substructure are configured higher than the inner bottom parts which are located closer to the center.

13. The powder spraycoating cabin substructure as claimed in claim 1, wherein the inner side of one of the outer bottom flaps overlaps the adjacent bottom part when the outer bottom flap is adjusted to a minimum width of the corresponding inner lengthwise bottom gap.

* * * * *